United States Patent [19]

Brook et al.

[11] 3,989,552

[45] Nov. 2, 1976

[54] METHOD OF MAKING A HEAT-RECOVERABLE ARTICLE

[75] Inventors: Greville B. Brook, Beaconsfield; Roger F. Iles, Ickenham, both of England

[73] Assignee: Fulmer Research Institute Limited, Stokes Poges, England

[22] Filed: Sept. 30, 1974

[21] Appl. No.: 510,172

Related U.S. Application Data

[63] Continuation-in-part of Ser. No. 88,970, Nov. 12, 1970, abandoned.

[30] Foreign Application Priority Data

Nov. 12, 1969 United Kingdom ..... 55481/69
Nov. 14, 1969 United Kingdom ..... 55969/69

[52] U.S. Cl. ..... 148/11.5 R; 148/12 R
[51] Int. Cl.[2] ..... C22D 1/00; C21D 7/02
[58] Field of Search ..... 148/11.5 R, 12; 75/170

[56] References Cited

UNITED STATES PATENTS 3,558,369 1/1971 Wang et al. ..... 148/11.5 R
3,567,523 3/1971 Jackson et al. ..... 148/11.5 R
3,594,239 7/1971 Wang ..... 148/13

*Primary Examiner*—W. Stallard
*Attorney, Agent, or Firm*—Brady, O'Boyle & Gates

[57] ABSTRACT

A method of making a heat-recoverable article which comprises cooling an article in a first shape from a first temperature to a lower temperature, said article being formed from an alloy comprising at least one phase in the form of a primary solid solution of a first metal with at least one other metallic element which increases the stability of a high temperature phase of the first metal, which solution on cooling from said first temperature retains the high temperature phase but which transforms into an essentially banded martensite phase on cold working and then plastically deforming the article into a second shape, the temperature and rate of cooling being such that, on reheating, the article at least partly resumes said first shape.

7 Claims, 3 Drawing Figures

METHOD OF MAKING A HEAT-RECOVERABLE ARTICLE

REFERENCE TO RELATED APPLICATIONS

This application is a continuation-in-part application Ser. No. 88970, filed Nov. 12, 1970, now abandoned.

BACKGROUND OF THE INVENTION

It is known that certain metal alloys are heat-recoverable, that is to say, when a suitably heat-treated article of one shape made from such an alloy is caused to deform into another shape at an appropriate temperature and the article is subsequently heated to a sufficiently higher temperature, said article will at least partly recover its original shape. This change of shape on reheating corresponds to a change of phase in the alloy from a low-temperature phase to a high-temperature phase. The phenomenon of heat recoverability is known to occur with articles made from nickel-titanium binary alloys containing 52 – 56 percent by weight of nickel and also with certain gold-cadmium and cadmium-silver-gold alloys. The known alloys which manifest this phenomenon are all intermetallic compounds.

DESCRIPTION OF THE INVENTION

We have now discovered that the same property of change of shape at a certain temperature, i.e., heat recoverability, can be obtained with materials which are not intermetallic compounds. Specifically, we have discovered that in articles made from primary solid solutions of certain iron alloys, it is possible to produce a transformation to a martensitic phase whereby said article exhibits the same phenomenon of reversible shape change on heating above a certain critical temperature which will vary somewhat with each alloy.

The term primary solid solution as utilized in this specification connotes the product obtained when atoms of one or more different elements can be added to a pure metal (in this case iron) without producing a change of crystal structure, by replacing atoms in the various sites of the pure metal crystal structure.

The term intermetallic compound as used in this specification connotes the single phase produced, other than a primary solid solution, when two or more metallic elements are alloyed together in the correct proportions. An intermetallic alloy usually has a crystal structure different from that of any of the constituent pure elements and also usually has a composition corresponding to a simple ratio of atoms, e.g., $A_xB_y$ where A and B are elements and $x$ and $y$ are numbers usually below 10. It also connotes such phases which also exhibit a range of solubility for the component elements around the simple atomic ratio without a change of crystal structure.

The treatment required to produce the phenomenon of heat recoverability with the solid solution alloys of the instant invention is to deform the article when it is at least partly in a high temperature, non-martensitic alloy phase so that the deforming stress induces the formation of martensite. Reheating the alloy to above a critical temperature will transform it back to the higher temperature phase and concurrently cause the article to revert fully or at least partly to its original shape. The crystalline phase of the alloy which is capable of undergoing this stress-induced transformation into the martensite phase is generally referred to as the austenite or $\gamma$-phase of the alloy. The temperature at which an alloy starts to transform into austenite on being heated in its martensite phase is generally referred to as the $A_s$ temperature, while the somewhat higher temperature at which the transformation to the austenite phase becomes complete is referred to as the $A_f$ temperature. Provided the alloy is not heated to too high a temperature, the process of deformation and recovery may be repeated again and again. The proviso for not heating the alloy to too high a temperature, i.e., too far above $A_f$, is because certain alloys on such heating revert to or towards a stable equilibrium state which cannot, therefore, be directly transformed by cooling and cold-working into martensite.

It has thus been found in accordance with the present invention that a useful heat-recoverable article is provided by a process which comprises cooling an article in a first shape from a first temperature to a lower temperature, said article being formed from an alloy comprising at least one phase in the form of a primary solid solution of a first metal with at least one other metallic element which increases the stability of a high temperature phase of the first metal, which solution on cooling from said first temperature retains the high temperature phase but which transforms into an essentially banded martensite phase on cold working, and then plastically deforming the article into a second shape, the temperature and rate of cooling being such that on reheating the article at least partly resumes said first shape.

In practice, an article formed from such an alloy is quenched to room or other suitable temperature such that the high temperature (austenite) phase is retained as a metastable high temperature solution. The article is then deformed into a new shape by cold working. This causes the alloy to transform from its high temperature austenite phase to a stress-induced martensite. On reheating the deformed shape so produced the martensitic phase commences to transform back to the high temperature austenite phase at the appropriate temperature (the $A_s$ temperature) and the article reverts to or at least towards its original shape. Transformation is complete on reaching the $A_f$ temperature. The extent to which the reversion to the original shape is complete depends on the extent to which the original deformation was accommodated by the formation of martensite. If slip or twinning accommodations also took place during deformation, this part of the deformation cannot be recovered.

If the alloys of the instant invention are cooled to a sufficiently low temperature that they have fully transformed to martensite without cold working, i.e., to or below the $M_f$ temperature, the heat recovery effect is not obtained, or is obtained only to a very minor extent. A useful amount of heat recoverable strain can only be obtained from martensite induced by stress from the metastable high temperature solid solution. The alloy is therefore preferably deformed above its $M_s$ temperature. If the alloy is cooled below its $M_s$ temperature (the temperature at which martensite starts to form spontaneously on cooling the high temperature metastable phase), but not to the $M_f$ temperature so that only partial transformation to martensite has occurred it is nevertheless possible to obtain some heat recoverable strain by deformation of the residual untransformed austenite, which then transforms to martensite under stress. The stress-formed martensite will at least partially recover on heating above the $A_s$ temperature.

If the alloy structure is not totally austenitic in the high temperature form, i.e., if it co-exists with a second phase (such as, in the case of iron alloys, a phase like delta ferrite, or alternatively an intermetallic compound) or if another solid solution or intermetallic compound precipitates during cooling, heat recoverable strain can still be obtained provided that (a) the austenitic phase(s) of such a composition transform into stress-induced martensite when cold worked, (b) there is not an excessive amount of the second phase generally not more than about 40 percent, (although the actual amount permissible depends somewhat on its distribution), and (c) the second phase does not interfere with stress-induced martensite formation.

DETAILED DESCRIPTION OF THE INVENTION

Figure 1:
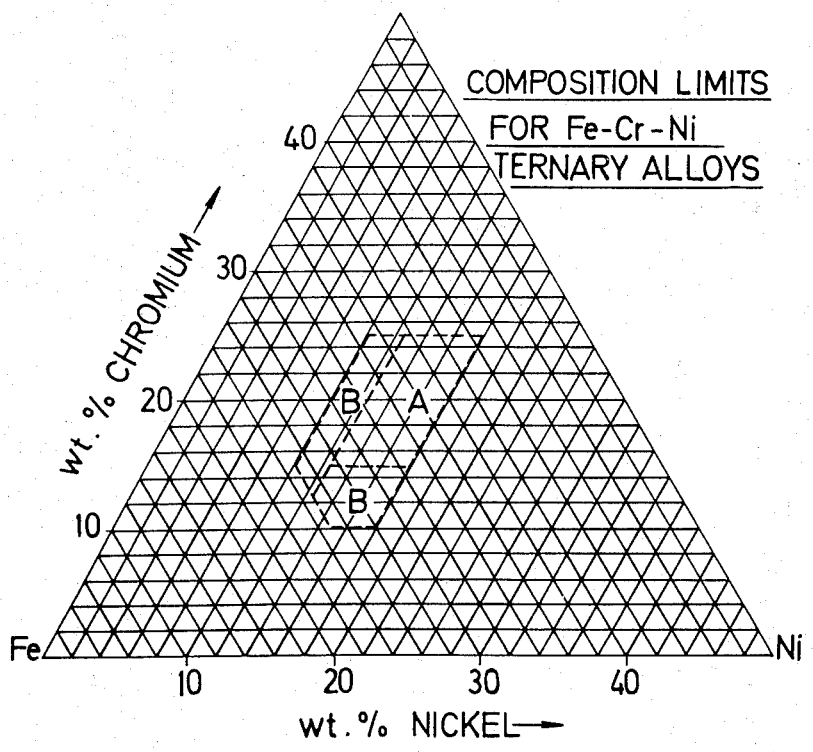

The solid-solution alloys suitable for the practice of the instant invention are all iron-base alloys. By that it is meant that at least about 50 percent of the metal atoms present in the alloy are iron. Amongst the alloys suitable for use in the present invention are alloys containing the elements Fe-Mn, Fe-Mn-Co, Fe-Ni-Cr-Co, Fe-Mn-Cr-Co, Fe,Mn-Cr,Ni-Co, and ternary and quaternary alloys containing Fe, Mn, Ni and/or Cr. Any of these solid-solution alloys are suitable provided that the austenitic (i.e., gamma) phase is retained on quenching from temperatures in the range of preferably about 800°–1200° C. The optimum quenching temperature and rate of cooling depends on the precise alloy composition and it is possible, for example, in alloys of low chromium content and high nickel or manganese content that the high temperature phase can be retained even on very slow cooling to room temperature.

The alloys of the instant invention may, of course, contain impurities and/or other incidental elements included to modify the properties of the alloy provided only that a solid solution exhibiting the required martensite transformation is maintained. For example, minor amounts of copper, aluminum, molybdenum, titanium and niobium can be present in amounts of up to about 2, 2, 5, 4 and 1.5 percent, respectively. The alloy can be a two-phase or multiphase alloy in which at least one phase is a solid solution as hereinbefore defined. The other phase or at least one of the other phases can consist of an intermetallic compound which is heat-recoverable as described in our copending Pat. application No. 88, 596 filed Nov. 12, 1970, now U.S. Pat. No. 3,783,037.

The composition should be such that on cold working below the Md temperature (the temperature at which martensite can be formed by deformation of a metastable high temperature solution) the following transformation sequence occurs: $\gamma$ to $\epsilon$ martensite (close-packed hexagonal) to $\alpha'$martensite (body centred cubic) or more preferably $\gamma$ to $\epsilon$ martensite. The more useful alloys have a low stacking fault energy which enables the $\epsilon$ martensite to be formed more readily. An increase in manganese and chromium content and/or a decrease in nickel content favour a reduction in stacking fault energy and consequently favors the formation of martensite. The significance of $\epsilon$ martensite is that its transformation strain is self-accommodating and its formation does not cause slip in the austenitic phase. $\alpha'$martensite is characterized by not being self-accommodating and its formation causes slip in the austenite phase. As heretofore indicated, strain giving rise to slip in the austenite phase cannot be recovered on reheating through the $A_s$ - $A_f$ temperature range.

Heat recoverable strain with the alloys of the instant invention is always associated with an anomalously low pseudo-elastic modulus. This is manifested at relatively low stresses because of the formation of stress-induced martensite by cold deformation of the austenite phase. When the yield stress of the austenite phase is also low the pseudo-elastic phenomenon may be masked by deformation of the austenite. This is observed especially when the nickel content of the alloy is high and the $M_s$ temperature relatively low. As the $M_s$ temperature is raised by increasing the iron content of the alloy or when solid solution hardening is produced by additions of elements such as aluminium, copper, molybdenum, the low pseudo-elastic modulus is more apparent.

We have found that the alloys used in this invention have high internal frictions or damping capacities when heat-treated in the manner described. This internal friction or damping capacity reaches its highest value at temperatures near to the $M_s$ and $M_f$ temperatures.

We have also discovered that the extent of the shape change on heating an article made of alloys treated according to this invention can be reduced or even prevented by applying sufficient stress to oppose the shape change. The removal of this stress after heating above the $A_s$ temperature allows the shape change to occur spontaneously instead of over a range of temperature as would have occurred in the absence of the opposing stress. The stress required to prevent the shape change whilst heating to a specific temperature is a measure of the force which can be developed by the alloy for doing external work. This discovery can be used in several ways. One method is to fully or partially suppress the shape change by an applied stress and then use the force or energy released when the restraining force is removed suddenly to operate a device, for example, through a lever or by impact on a pin or by deforming or fracturing a suitable element of the device. Another method to use the force developed is to heat the part made from the heat recoverable material slowly through the $A_sA_f$ temperature range when it will exert a sustained and progressively increasing force on the operating element of the device as mentioned before. By control of the temperature, the rate and amount of increase of force or of movement can be controlled.

The heat-recoverable properties possessed by articles made in accordance with the present invention render them useful for many purposes where a change of shape of temperature is necessary. For example, they may be used as tubes in couplings, which tubes change shape to grip two elements to be connected together, as temperature-responsive devices in switching devices and as springs.

In the following Examples, the terms "retained strain" and "heat recoverable strain" have the following meanings.

1. RETAINED STRAIN a. The amount of permanent strain retained after a specimen has been deformed in tension. This will be expressed as a percentage strain based on a gauge length of 1 inch.

b. The angle retained when a straight specimen 0.031 inch thick is bent through an angle of 180°, i.e., so the two arms of the specimen are parallel, and then allowed to relax elastically. A bend of 180° corresponds to a surface strain of about 4.25 percent.

2. HEAT RECOVERABLE STRAIN

This is expressed as:

a. As the actual percentage of the strain recovered on heating through the $A_s$ to $A_f$ temperature range in terms of the original gauge length of 1 inch.

b. It is the total angular movement from a specimen which has been originally bent to 180° and relaxed elastically and has then been heated through the temperature range $A_s$–$A_f$.

Which type of strain is reported, i.e., whether as a percentage tensile strain or as an angle of bend will depend on the type of experiment which was performed and this in turn depends on the application of the material industrially.

EXAMPLES i. IRON-CHROMIUM-NICKEL ALLOYS:

These alloys were heat treated for ½ hour at 1000° C and water quenched. This produced a meta-stable austenitic structure with an average grain size of approximately 0.1 mm.

Areas A and B in FIG. 1 represent the alloys in which significant amounts of heat recoverable strain can be obtained. Area A designates the preferred range of alloys.

Area A alloys are bounded by the lines

1. Cr = 25 percent
2. Ni = 12.5 percent
3. Ni = 18 percent
4. Cr = 15 percent

Area B alloys are bounded by the lines

1. Cr = 25 percent
2. Ni = 10 percent
3. Ni = 18 percent
4. Cr = 10 percent
5. Fe = 75 percent The lower nickel limit which is approximately 10 percent corresponds to spontaneous martensite formation on cooling from the austenitic phase and such alloys cannot be readily deformed. Above the upper nickel limit which is 18 percent, the high temperature austenitic phase is retained in a condition which is stable to temperatures at least down to −196° C such that on cold deformation no strain induced martensite can be produced. Below the low chromium limit 10 percent, heat recoverable strain has not been observed; at the upper limit of 25 percent chromium the structure contains austenite plus delta ferrite on cooling from up to 1200° C in the high temperature phase field. Some heat recoverable strain can occur from deformation of the austenitic phase but this decreases as the amount of delta ferrite is increased.

Optimum heat recoverable strain is obtained when (a) the $M_s$ is below −196° C and strain induced martensite forms when cold working at −196° C. This is at the higher levels of chromium and nickel in region A., (b) when alloys are cold worked at the lowest temperature possible when austenite is retained as quenched. −196° C is preferable to deforming at −70°or 20°. These are general principles for all iron-base alloys. Specific examples are as follows:

| Iron - 20% Chromium - 15% Nickel | | |
|---|---|---|
| | Heat Recoverable Strain | |
| Retained Strain at −(96° C | % Tensile Strain | Equivalent Angular Movement |
| 4.8% | 0.7% | 35° |
| 14.6% | 1.05% | 50° |
| 28.8% | 1.05% | 50° |

This alloy is completely austenitic when cooled to −196° but does not show the anomalously low pseudo-elastic modulus. The Table shown above shows the general trend in iron-base alloys when heat recoverable strain increases with retained strain until a limiting value is reached after which the heat recoverable strain remains constant.

| Iron - 12½% Chromium - 12½% Nickel | | | | |
|---|---|---|---|---|
| | The alloy was deformed by bending | | | |
| | Retained Strain | | Heat Recoverable Strain | |
| Temperature of Bending | Angular | Corresponding % Surface Strain | Angular Movement | Corresponding % Surface Strain |
| −70° C | 153° | 3.62% | 15° | 0.36% |
| −196° C | 147° | 3.49% | 23° | 0.57% |

This alloy had partially transformed to martensite at −196° C.

| Iron - 25% Chromium - 15% Nickel | | |
|---|---|---|
| The alloy was deformed in tension | | |
| | Heat Recoverable Strain | |
| Retained Strain at −196° C | % Tensile Strain | Equivalent Angular Movement |
| 5.4% | 0.65% | 30° |
| 14.4% | 0.80% | 36° |

This alloy contained approximately 10 percent delta ferrite but this did not prevent heat recoverable properties being obtained.

ii. IRON-CHROMIUM-NICKEL-MANGANESE ALLOYS:

Manganese can be substituted partially or completely for nickel in iron-chromium-nickel alloys and behaves in a similar way to nickel. This invention may employ iron-base alloys containing 10–25 percent chromium in which both nickel and manganese are added to give alloys such that they contain little or no martensite on quenching from the high temperature phase but will form stress induced martensite on straining at temperatures in the range −196° C to +20° C. Alloys in areas *a*, *b* and *c* in FIG. 2 were found to exhibit heat recoverable strain. The inner shaded area *b*, is the preferred range.

Figure 2:
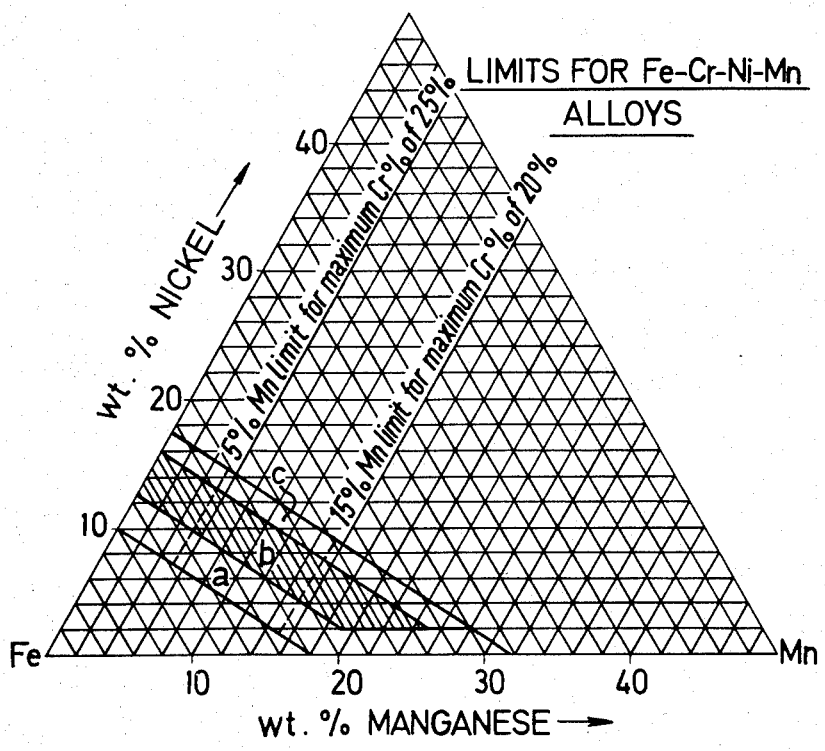

For the nickel and manganese contents shown in the areas a, b and c in FIG. 2, the basic heat recoverable alloy contains between 10 and 17.5 weight percent chromium, the remainder being iron.

Heat recoverable strain was also found in alloys within areas *a*, *b* and *c* of FIG. 2 in which the chromium content extends up to a maximum of 20 percent when manganese does not exceed 15 percent.

Heat recoverable strain was also found in alloys within areas *a*, *b* and *c* of FIG. 2 in which the chromium content extends up to a maximum of 25 percent when manganese does not exceed 5 percent. Within these ranges, the maximum chromium content can be increased in steps of 1 percent provided the maximum manganese content is reduced in steps of 2 percent and vice versa, the nickel content remaining within the areas *a*, *b* and *c* relative to the manganese contents, the remainder being iron.

The limitation on chromium to 17½ percent at manganese contents above 15 percent is necessary because the alloys become too brittle to fabricate.

The three areas *a*, *b* and *c*, are defined as follows:

Area (a) alloys bounded by the lines:

1. weight percent nickel = 12½ - (0.575 × wt. percent manganese)
2. weight percent nickel = 2
3. weight percent nickel - 17½ percent - (0.575 × wt. percent manganese)
4. weight percent nickel = 10-(0.575 × wt. percent manganese)
5. weight percent manganese = 0
6. weight percent nickel = 0

Area (b) alloys bounded by the lines:

1. weight percent nickel = 12½-(0.575 × wt. percent manganese)
2. weight percent nickel = 16–(0.575 × wt. percent manganese)
3. weight percent nickel = 2
4. weight percent manganese = 0

Area (c) alloys bounded by the lines:

1. weight percent nickel = 16–(0.575 × wt. percent manganese)
2. weight percent nickel = 17½–(0.575 × wt. percent manganese)
3. weight percent nickel = 2
4. weight percent manganese = 0

All these quaternary alloys were solution treated for ½ hour at 1050° C and water quenched to retain an austenite with approximate grain size 0.1mm. Specific examples are as follows:

| Iron - 15% Chromium - 11% Nickel - 6.5% Manganese | | |
|---|---|---|
| | Heat Recoverable Strain | |
| Retained Strain at −196° C | % Tensile | Equivalent Angular Movement |
| 5% | 0.55% | 25° |
| 20% | 0.50% | 22° |

This alloy did not show the pseudo-elastic modulus on deforming.

| Iron - 15% Chromium - 5% Nickel - 17½% Manganese | | |
|---|---|---|
| | Heat Recoverable Strain | |
| Retained Strain at −196° C | % Tensile | Equivalent Angular Movement |
| 5% | 0.95% | 42° |
| 20% | 1.30% | 56° |

iii. IRON-CHROMIUM-MANGANESE ALLOYS

Manganese can be substituted completely for nickel in Iron-Chromium-Nickel alloys within the chromium composition range 10–17½ percent as indicated by FIG. 2 while retaining heat-recoverable properties. The maximum range for manganese is 17.5 to 30.5 percent, and the preferred range is 20 to 27.5 percent by weight of manganese. The alloys were heat treated for ½ hour at 1000° C and quenched into water.

A specific example of an alloy, which was deformed in tension is as follows:

| Iron - 15% Chromium - 25% Manganese | | |
|---|---|---|
| | Heat Recoverable Strain | |
| Retained Strain at −196° C | % Tensile | Equivalent Angular Movement |
| 4.6% | 0.4% | 18° |

This alloy was partially martensitic at −196° C with a fairly low elongation to fracture of 6.6 percent at failure. At −70° C and above the stress-strain curve indicated the fully retained austenitic structure and the low pseudo-elastic modulus was not discernible. On deformation at temperatures of −70° C and above no heat recoverable strain was obtained.

iv. IRON-CHROMIUM-NICKEL-COBALT ALLOYS

Cobalt acts as an austenite stabiliser in stainless steels. We have found that cobalt can be added to Iron-Chromium-Nickel alloys, in amounts up to 20 wt. percent cobalt, while still retaining heat recoverable properties, provided there is an adjustment in the chromium and nickel levels to maintain the appropriate $M_s$ temperature. By adding cobalt, improved heat recoverable strains are obtained in alloys containing as little as 10% chromium, which is the minimum chromium content at which heat-recoverable strain can be obtained in iron-nickel-chromium ternary alloys. The alloys containing iron-chromium-nickel-cobalt which show heat recoverable properties can be defined with reference to FIG. 1, where up to 20 percent by weight of cobalt can be added provided that the following reductions in chromium and nickel limits are observed. The maximum chromium content must be reduced by 1 percent for each 4 percent of cobalt added, and the minimum chromium content must be reduced by 1 percent for each 8 percent cobalt added. The maximum nickel content must be reduced by 1 percent for each 8 percent of cobalt added, and the minimum nickel content must be reduced by 1 percent for each 4 percent of cobalt added. The alloys were heat treated for ½ hour at 1000° C and quenched into water.

As examples, the following alloys were cold deformed by bending at −196° C.

| Fe-10% Chromium - 15% Nickel - 20% Cobalt | | | |
|---|---|---|---|
| Retained strain at −196° C | | Heat Recoverable Strain | |
| Angular | Corresponding % Surface Strain | Angular Movement | Corresponding % Surface Strain |
| 123° | 2.92% | 28° | 0.64% |

| Fe-15% Chromium - 15% Nickel - 20% Cobalt | | | |
|---|---|---|---|
| Retained Strain at −196° C | | Heat Recoverable Strain | |
| Angular | Corresponding % Surface Strain | Angular Movement | Corresponding % Surface Strain |
| 157° | 3.74% | 38° | 0.90% |

v. IRON-CHROMIUM-MANGANESE-COBALT ALLOYS

Cobalt can be added to ternary Iron-Chromium-Manganese alloys as a partial replacement for manganese in amounts up to 15 percent by weight of cobalt while retaining heat recoverable properties, provided the following reductions are made in the outer limits for chromium and manganese shown for iron-chromium-manganese alloys in FIG. 2. The chromium limits are reduced by 12.5 percent of the percentage of cobalt added, and the manganese limits are reduced by 50 percent of the percentage of cobalt added. The alloys were heat treated for ½ hour at 1000° C and quenched into water.

As an example, the following alloy was cold deformed by bending at −196° C.

| Iron - 15% Chromium - 15% Manganese - 10% Cobalt | | | |
|---|---|---|---|
| Retained Strain at −196° C | | Heat Recoverable Strain | |
| Angular | Corresponding % Surface Strain | Angular Movement | Corresponding % Surface Strain |
| 143° | 3.4% | 41° | 1.0% |

vi. IRON-MANGANESE ALLOYS

If the manganese content is above 15 percent some heat recoverable strain can be obtained which is associated with the austenite to ϵ martensite transformation. This is possible in alloys containing 15–35 percent manganese and the preferred range contains 20–30 percent manganese. The amount of heat recoverable strain is increased if titanium is added in appropriate quantities, that is up to 5 percent, which will reduce the $M_s$ temperature without altering the proportion of ϵ martensite. The alloys were heat treated for ½ hour at 1000° C and quenched into water. A specific example is iron containing 28 percent manganese, deformed by tensile straining or bending at different temperatures and heated to above the $A_s$.

| | | Heat Recoverable Strain | | |
|---|---|---|---|---|
| Temperature ° C of straining, | Retained Strain | % Tensile Strain | Equivalent Angular Movement | |
| −196 | 5% | 0.35% | 15° | |
| −196 | 20% | 0.55% | 25° | |
| | Angular | Corresponding % Surface Strain | Angular Move-ment | Corresponding % Surface Strain |
| −70 | 109° | 2.6% | 18° | 0.38% |
| +20 | 109° | 2.6% | 22° | 0.50% |
| +100 | 136° | 3.24% | 17° | 0.37% |

A further example is an Iron-Manganese alloy containing 20 percent by weight of manganese, and 3.75 percent by weight of titanium, deformed by bending at −196° C,

| Fe - 20% Manganese - 3.75% Titanium | | | |
|---|---|---|---|
| Retained Strain at −196° C | | Heat Recoverable Strain | |
| Angular | Corresponding % Surface Strain | Angular Movement | Corresponding % Surface Strain |
| 131° | 3.10% | 68° | 1.48% |

vii. Iron - Manganese - Nickel Alloys

Figure 3:
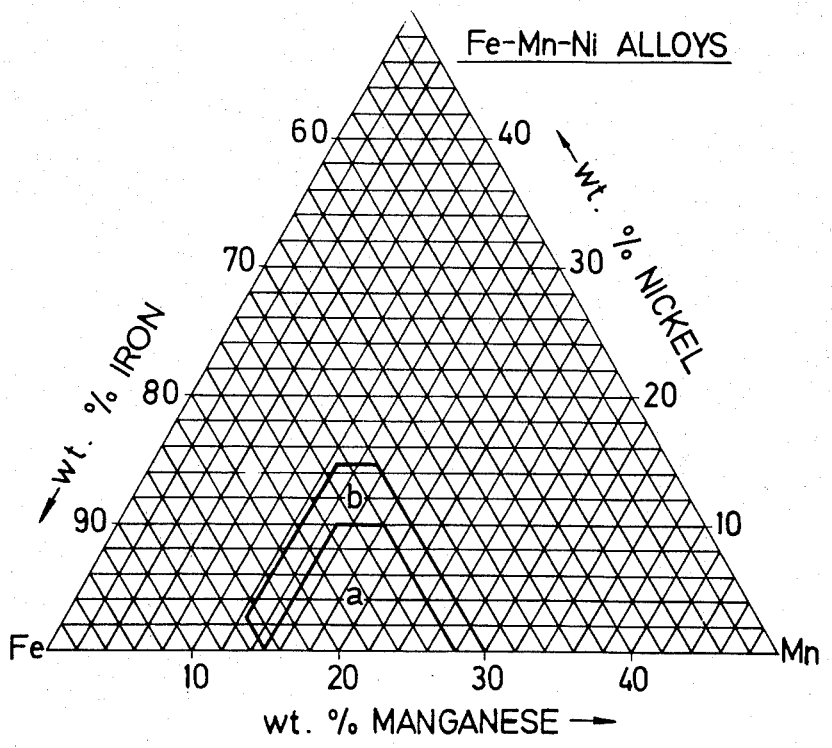

Nickel can be added to Iron-Manganese alloys as a partial replacement for manganese while retaining heat recoverable properties, within the limits indicated in FIG. 3. Area a in FIG. 3 is the preferred range and area b is the overall range. These are defined as follows: region a, alloys bounded by the lines 1. Mn = 15 percent
2. Fe = 72 percent
3. Ni = 10 percent
4. Ni = 0 percent and region *b*, alloys bounded by the lines 1. Mn = 12 ½ percent
2. Fe = 70 percent
3. Ni = 15 percent
4. Ni = 0 percent
5. Fe = 85 percent The alloys were heat treated for ½ hour at 1000° C and quenched into water.

For example, the following alloy was deformed by bending at −196° C.

| Iron - 15% Manganese - 10% Nickel | | | |
|---|---|---|---|
| Retained Strain at −196° C | | Heat Recoverable Strain | |
| Angular | Corresponding % Surface Strain | Angular Movement | Corresponding % Surface Strain |
| 128° | 3.04% | 49° | 0.92% |

RAPID LOADING

In one method of applying the invention, alloy systems retaining the high temperature austenitic phase were cold worked at a high rate. This involved immediate application of a shock load such that the amount of strain was limited at a predetermined level. Specific examples are given in the following table:

| | SLOW LOADING Heat Recoverable Strain | | | RAPID LOADING Heat Recoverable Strain | | |
|---|---|---|---|---|---|---|
| | Residual Strain at −196° C | % Tensile Strain | Equivalent Angular Movement | Residual Strain at −196° C | % Tensile Strain | Equivalent Angular Movement |
| F2-21%Cr-9%Ni-9%Mn | 5% | 0.95% | 42° | 5% | 0.95% | 42° |
| " | 20% | 0.85% | 38° | 11.6% | 1.2% | 52° |
| Fe-12½%Cr-17½Mn | 5% | 0.55% | 25° | 11% | 0.65% | 30° |
| " | 25% | 0.55% | 25° | 16.6% | 0.65% | 30° |
| Fe-15%Cr-5%Ni-7½%Mn | 20% | 1.3% | 56° | 20% | 1.55% | 68° |
| Fe-20%Cr-10%Ni 5%Mo | 5% | 0.75% | 34° | 2.4% | 1.05% | 45° |

Thus, it will be seen that rapid loading if beneficial.

RE-HEATING UNDER LOAD

If, instead of removing the load from a specimen that has been cold deformed in tension at −196° C., some remaining load is left applied, the specimen will exhibit heat recoverable strain on heating. However, the amount of heat recoverable strain decreases with increasing load until a stress is reached that is approximately or just above the yield stress of the austenite at the elevated temperature. When this situation is reached the specimen will not recover but will expand. A specific example follows with reference to Iron-20% Chromium - 15% Nickel.

| Iron-20% Chromium-15% Nickel | | | |
|---|---|---|---|
| | | Heat Recoverable Strain on heating to 250° C | |
| % Residual Strain at −196° C | Stress Retained during heating p.s.i. | % Tensile Strain | Equivalent Angular Movement |
| 14.6% | nil | 1.05% | 45° |
| 15.7% | 10,000 | 0.55% | 25° |
| 15.6% | 20,000 | 0.2% | 11° |
| 15.8% | 28,000 | 0.1% | 2° |
| 15.4% | 40,000 | +0.1% | nil |

What is claimed is:

1. A method of making a heat-recoverable article which comprises cooling an article in a first shape from a first temperature to a lower temperature, said article being formed from an alloy comprising at least one phase in the form of a primary solid solution of a first metal with at least one other metallic element which increases the stability of a high temperature phase of the first metal, which solution on cooling from said first temperature retains the high temperature phase but which transforms into an essentially banded martensite phase on cold working, and then deforming the article into a second shape by cold working, the temperatures and rate of cooling being such that, on reheating, the article at least partly resumes said first shape, said alloy comprising Fe-Mn, Fe-Mn-Co, Fe-Ni-Cr-Co, Fe-Mn-Cr-Co, Fe-Mn-Cr-Ni-Co, or another ternary or quaternary alloy containing Fe and at least one of the elements Mn, Ni and Cr.

2. The method of claim 1 wherein said alloy contains up to about 2% copper, up to about 2% aluminum, up to about 5% molybdenum, up to about 4% titanium, up to about 1.5% niobium, or mixtures thereof.

3. The method of claim 1 wherein said cooling is effected by quenching.

4. The method of claim 1 wherein said article is cooled to a temperature above the $M_f$ temperature of said alloy.

5. The method of claim 1 wherein said article is cooled to a temperature above the $M_s$ temperature of said alloy.

6. The method of claim 1 wherein said article is deformed at above the $M_s$ temperature of said alloy.

7. The method of claim 1 wherein said article is deformed at above the $M_f$ temperature of said alloy.

* * * * *